United States Patent [19]

Kawai et al.

[11] 4,391,004

[45] Jul. 5, 1983

[54] SPRAYING DEVICE FOR USE IN TOILET BOWLS

[75] Inventors: Shinji Kawai, Toyota; Koichi Suzuki, Chiryu; Yuji Yamaguchi, Anjyo, all of Japan

[73] Assignee: Aisin Seiki Kabushiki Kaisha, Kariya, Japan

[21] Appl. No.: 376,219

[22] Filed: May 7, 1982

[30] Foreign Application Priority Data

May 9, 1981 [JP] Japan ..... 56-070021

[51] Int. Cl.[3] ..... A61H 35/00; A47K 3/22

[52] U.S. Cl. ..... 4/443; 4/420.4; 4/447; 4/448

[58] Field of Search ..... 4/444, 443, 447, 446, 4/448, 420.1, 420.2, 420.3, 420.4, 420.5

[56] References Cited

U.S. PATENT DOCUMENTS

| | | | |
|---|---|---|---|
| 2,094,170 | 9/1937 | Heald | 4/420.2 |
| 3,570,015 | 3/1971 | Rosengaus | 4/420.4 |
| 4,068,325 | 1/1978 | Bethin | 4/420.4 |
| 4,087,868 | 5/1978 | Gantz | 4/447 |
| 4,181,985 | 1/1980 | Rius | 4/420.4 X |
| 4,304,016 | 12/1981 | Oguma et al. | 4/443 X |
| 4,340,980 | 7/1982 | Fushimi et al. | 4/448 |

*Primary Examiner*—Henry K. Artis

*Attorney, Agent, or Firm*—Finnegan, Henderson, Farabow, Garrett & Dunner

[57] ABSTRACT

A rectal sprayer for use in toilets having a toilet bowl and toilet seat, which sprayer includes a spray deflecting member located at the side of the toilet bowl at a position to which a spraying head is retracted following use. When in the retracted position the spraying head confronts the deflecting member which is adapted to deflect water, sprayed thereat by the spraying head, back toward the spraying head to effect the cleaning thereof.

5 Claims, 9 Drawing Figures

SPRAYING DEVICE FOR USE IN TOILET BOWLS

This invention relates to a spraying device for use in toilet bowls and, more particularly, to means for cleaning the spraying head of the sprayer.

It is known to mount a spraying device on a toilet bowl through a pivoted support arm for the purpose of cleaning the anal area and immediately surrounding region of the user by means of a warm water spray. The spraying device, in addition to the support arm which is a hollow pipe connected to a warm water tank, includes a spraying head which is mounted on the support arm for pivoting between a retracted position in which the spraying device is protected from soiling, and an extended position, which is the position of use, located immediately below the seated user. When the spraying head is in the extended position, the warm water is sprayed generally upward to effect the cleaning operation.

Although the spraying device of the type described serves the intended purpose, experience has shown that the spraying head will become soiled after repeated use. This will give rise to an unsanitary condition, a problem which heretofore has not been suitably addressed.

Accordingly, an object of the present invention is to provide a spraying device for use in toilets which possesses a self-cleaning function for the purpose of removing matter attaching to the spraying head area of the device.

To this end, the present invention provides a spraying device provided with a spray deflecting member located at the side of the toilet bowl at a position to which the spraying head is retracted for following use. The spraying head, when in the retracted position, directly confronts the deflecting member and is adapted to spray water toward the deflecting member. The sprayed water impinges upon the deflecting member and is deflected back toward the spraying head to effect the cleaning thereof.

Other features and advantages of the present invention will be apparent from the following description taken in conjunction with the accompanying drawings, in which like reference characters designate the same or similar parts throughout the figures thereof.

Figure 1:
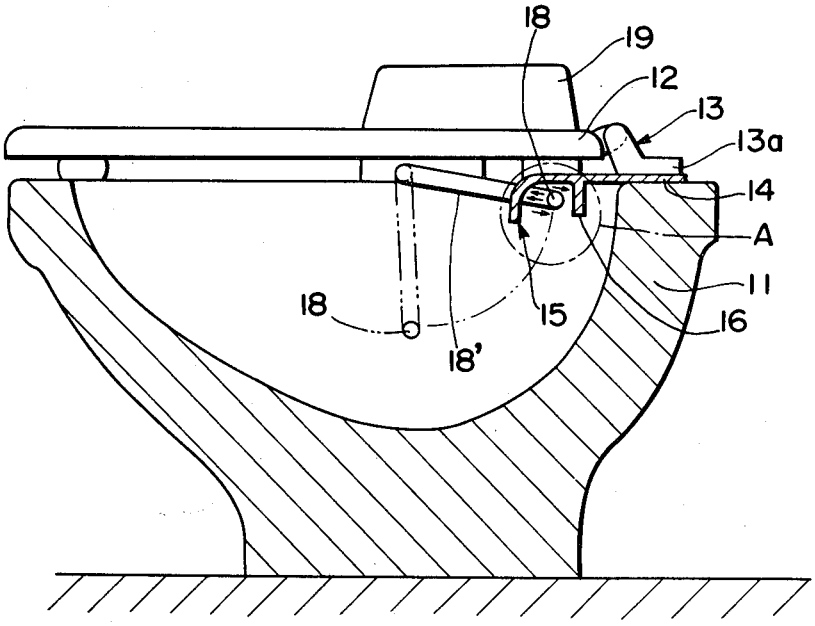
FIG. 1 is a partly sectioned side view illustrating a first embodiment of a spraying device according to the present invention.
Figure 2:
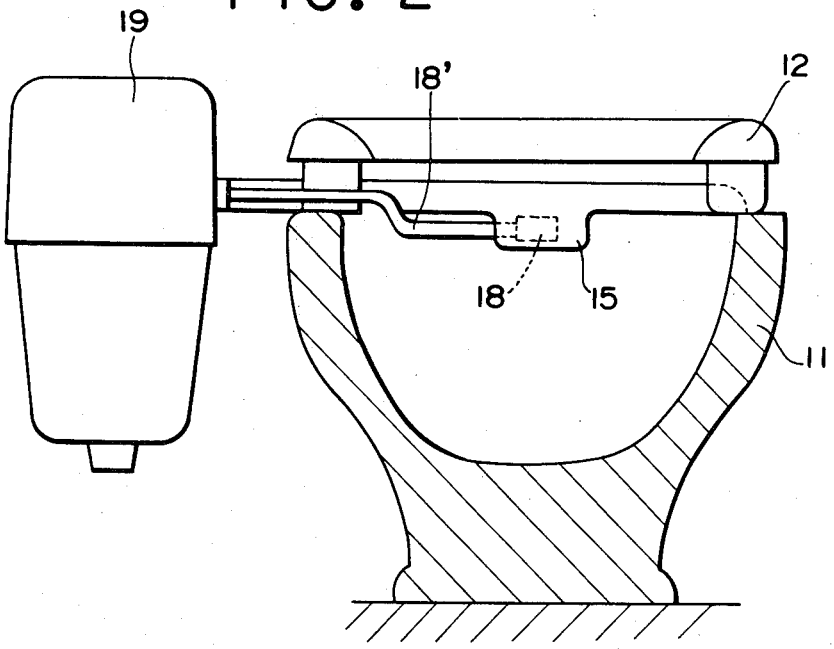
FIG. 2 is a partly sectioned front view of the device shown in FIG. 1.
Figure 3:
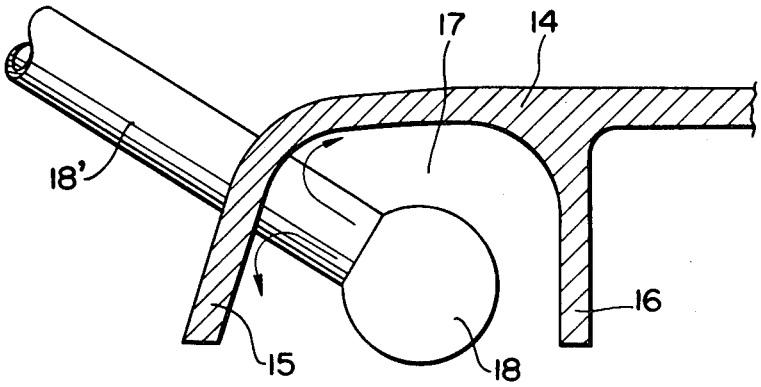
FIG. 3 is an enlarged view of the area A shown in FIG. 1.

Referring to FIGS. 1 through 3, a toilet in which the present invention is used includes a toilet bowl 11, a U-shaped toilet seat 12, and a hinge 13 for pivotally mounting the toilet seat 12 on the toilet bowl 11 at the rear portion thereof. The spraying arrangement of the present invention includes a spray deflecting member in the form of a plate 14 having one end thereof mounted on the toilet bowl 11 at the rear portion thereof between the base **13*a* of the hinge 13 and the toilet bowl 11. The other end of the plate 14 extends into the toilet bowl 11 at the rear portion thereof, where it will not be soiled, and is formed to include opposing walls 15, 16 which project downwardly into the toilet bowl 11 to form a cavity 17 whose opening faces downwardly. The arrangement further includes a spraying head 18 mounted at one end of a hollow support arm 18'. The other end of the support arm 18' is connected to an externally located warm water tank 19, whereby water from the tank 19 may be supplied to the spraying heat 18 through the support arm. The support arm 18' is adapted to be pivoted by a lever, not shown, to move the spraying head 18 between a spraying position indicated by the phantom lines in FIG. 1, at which position the spraying head underlies the anal area of a seated individual to permit the spray cleaning of such area, and a retracted spraying position, indicated by the solid lines in FIG. 1 at the side of the bowl, at which position the spraying head 18 is received within the cavity 17 between the opposing walls 15, 16 in such fashion as to confront the wall 15. Manipulating the lever with the spraying head 18 received in the cavity 17 in the manner described causes the retracted spraying head 18 to eject a spray of warm water toward the inner surface of wall 15 of the plate 14. Water sprayed against the wall 15 in this manner is deflected back toward the spraying head 18** with sufficient force to clean the spraying head of any matter that may have attached itself thereto during the previous anal or rectal cleaning operation.

Figure 4:
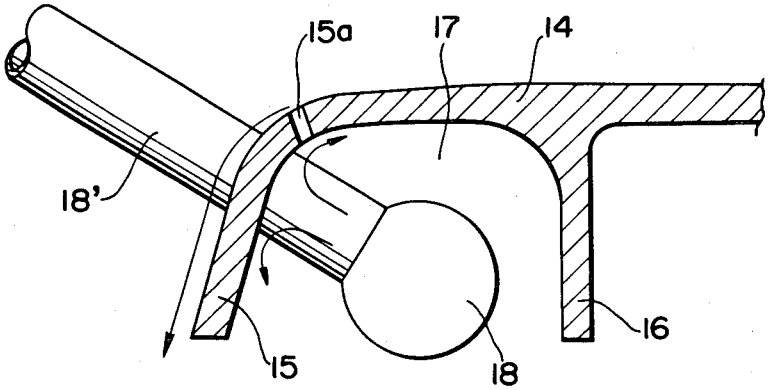
FIG. 4 is an enlarged view, corresponding to that of FIG. 3, illustrating a second embodiment of a spraying device according to the present invention.

Another embodiment of the present invention is illustrated in FIG. 4, in which the wall 15 of the plate 14 has at least one through-hole **15*a* at a position facing the spraying head 18. The through-hole 15*a* permits part of the water sprayed toward the wall 15 to wash away any matter which may have attached itself to the outer side of the wall 15**.

Figure 5:
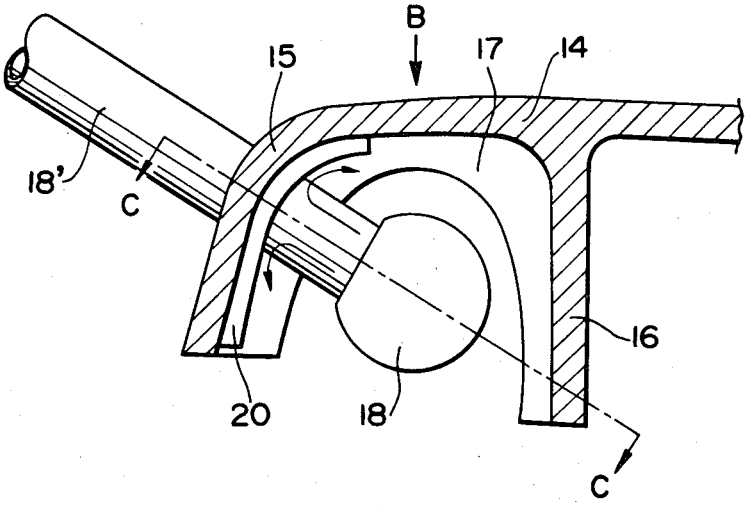
FIG. 5 is an enlarged view, corresponding to that of FIG. 3, illustrating a third embodiment of a spraying device according to the present invention.
Figure 6:
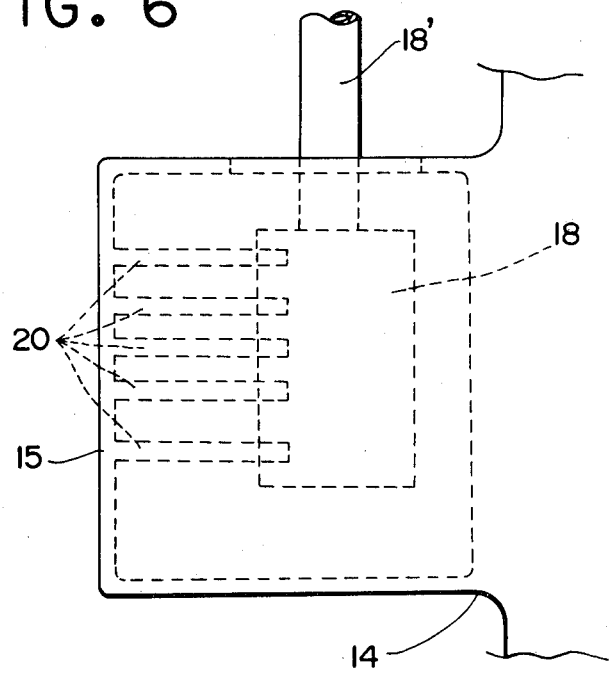
FIG. 6 shows the arrangement of FIG. 5 as seen from the direction of arrow B.
Figure 7:
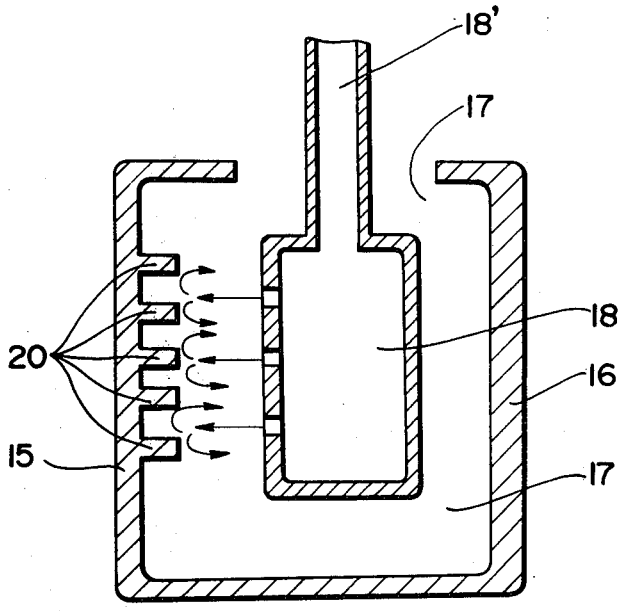
FIG. 7 is a sectional view taken on line C—C of FIG. 5.

FIGS. 5 through 7 illustrate a third embodiment of the present invention, in which the inner side of wall 15 is provided with a plurality of substantially parallel fins 20 extending upwardly along the wall 15 from the lower end thereof to a point substantially beyond the portion of wall 15 at which the water spray is directed. The fins 20 prevent lateral diffusion of the water impinging upon the inner side of the wall 15 and thus permit a greater quantity of water to be deflected backward toward the spraying head 18, thereby enhancing the spraying head cleaning effect.

Figure 8:
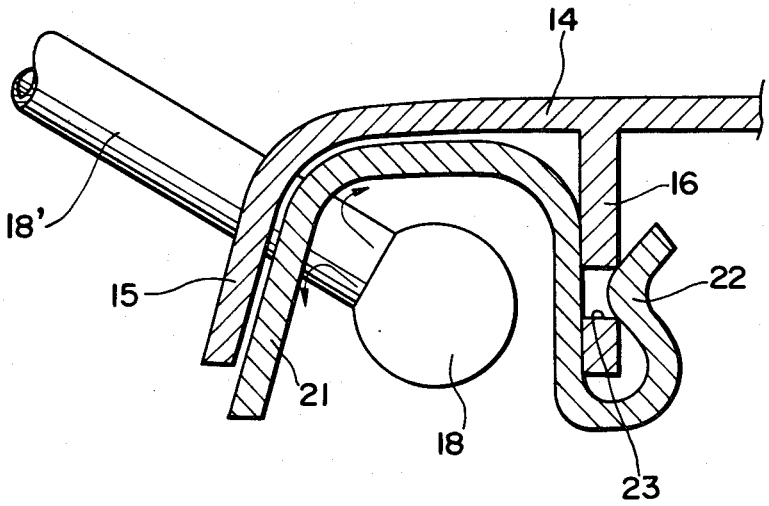
FIG. 8 is an enlarged view, corresponding to that of FIG. 3, illustrating a fourth embodiment of a spraying device according to the present invention.
Figure 9:
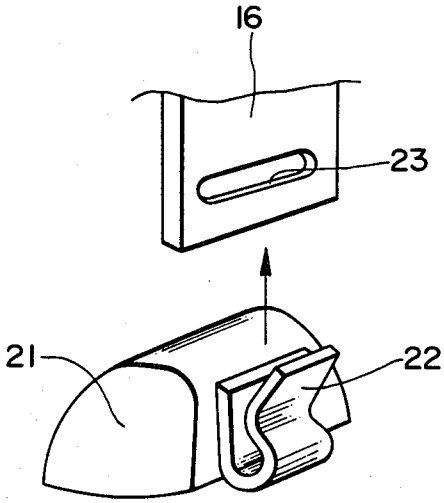
FIG. 9 is an exploded perspective view of the portion shown in FIG. 8.

A further embodiment of the present invention is illustrated in FIGS. 8 and 9, in which the deflecting member comprises a hood 21 having a clip member 22 attached thereto. The wall 16 of the plate 14 has an elongated hole or slot 23 formed therein to receive a corresponding projection formed on the clip member. The hood 21 is inserted into the cavity 17 with its open end facing downward, and is removably fastened to the wall 16 by fitting the projection on the clip 22 into the slot 23 formed in wall 16. As in the previous embodiments the spraying head 18 is adapted to be moved to the retracted position between the walls 15 and 16, which are now covered by the replaceable hood 21. The inner side of hood 21 facing the retracted spraying head 18 serves the same purpose as the wall 15 of plate 14 in the previous embodiments, said inner side deflecting the sprayed water back toward the spraying head 18 to effect the cleaning thereof. The hood 21 thus prevents the plate 14 from being soiled and can be replaced by a new hood after prolonged use, if so desired.

As many apparently widely different embodiments of the present invention may be made without departing from the spirit and scope thereof, it is to be understood that the invention is not limited to the specific embodiments thereof except as defined in the appended claims. We claim:

1. A spraying device for use in toilets of the type having a toilet bowl and toilet seat, which rectal spraying device comprises:

a spraying head for spraying water;

means mounting said spraying head in the toilet bowl for moving said spraying head between a first spraying position underlying the anal or rectal area of an individual seated on the toilet seat, and a second spraying position located at the side of the toilet bowl; and a spray deflecting member mounted on the toilet bowl at said second spraying position for confronting said spraying head when said spraying head is moved to said second spraying position;

water ejected from said spraying head at said second spraying position being deflected back toward said spraying head.

2. A spraying device according to claim 1, in which said spray deflecting member is provided with at least one through-hole at a position which opposes said spraying head.

3. A spraying device according to claim 1, in which said spray deflecting member is provided with a plurality of substantially parallel fins on the side thereof confronting said spraying head in said second spraying position.

4. A spraying device according to claim 1, in which said spray deflecting member is replaceable.

5. A spraying device according to claim 1, in which said spray deflecting member comprises a plate having one end thereof fixedly mounted on the toilet bowl at the rear portion thereof and having the other end thereof extended into the toilet bowl at said second spraying position, said other end of said plate having first and second opposing wall members projecting downwardly into the toilet bowl for forming a downwardly open cavity, said spraying head being received within the cavity when moved to said second spraying position in such a manner that said spraying head opposes said first wall member.

* * * * *